US010167112B2

(12) United States Patent
Anderson et al.

(10) Patent No.: US 10,167,112 B2
(45) Date of Patent: Jan. 1, 2019

(54) PROTECTING PALLET BLOCKS

(71) Applicant: International Business Machines Corporation, Armonk, NY (US)

(72) Inventors: Ryan R. Anderson, Rochester, MN (US); William J. O. Green, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/662,550

(22) Filed: Jul. 28, 2017

(65) Prior Publication Data

US 2018/0105321 A1 Apr. 19, 2018

Related U.S. Application Data

(63) Continuation of application No. 15/293,854, filed on Oct. 14, 2016.

(51) Int. Cl.
*B65D 19/38* (2006.01)

(52) U.S. Cl.
CPC ..... *B65D 19/38* (2013.01); *B65D 2519/0086* (2013.01); *B65D 2519/00706* (2013.01)

(58) Field of Classification Search
CPC ..... B65D 19/38; B65D 2519/00706; B65D 2519/0086
See application file for complete search history.

(56) References Cited

U.S. PATENT DOCUMENTS

| | | | |
|---|---|---|---|
| 4,715,294 | A | 12/1987 | DePew |
| 4,850,284 | A | 7/1989 | DeGroot et al. |
| 5,329,861 | A | 7/1994 | McCarthy |
| 5,673,629 | A | 10/1997 | Ginnow |

(Continued)

FOREIGN PATENT DOCUMENTS

| | | | |
|---|---|---|---|
| CN | 2889926 | Y | 4/2007 |
| CN | 200939968 | Y | 8/2007 |

(Continued)

OTHER PUBLICATIONS

IBM, "ESD / Shock protected foam pallet storage solution," An IP.com Prior Art Database Technical Disclosure, ip.com, Original Publication Date: Oct. 30, 2008, IP.com Electronic Publication Date: Oct. 30, 2008, IP.com No. IPCOM000175970D, 3 pages.

(Continued)

*Primary Examiner* — John C Hong
(74) *Attorney, Agent, or Firm* — Peter J. Edwards

(57) ABSTRACT

The present invention provides a block protector assembly including a protector contoured to conform to a block of pallet where the pallet includes a plurality of blocks, and an attachment mechanism coupled to the protector, where the attachment mechanism is configured to secure the protector to the block of the pallet, where the protector includes a rigid material. The present invention also provides a method including determining a contour of a block of a pallet, fabricating a protector to follow the contour of the block, and securing the protector to the block. In addition, the present invention provides a protector configured to prevent damage to a block of a pallet, where the protector includes a first side contoured to a first side of the block, a second side contoured to a second side of the block, and a third side contoured to a third side of the block.

1 Claim, 9 Drawing Sheets

(56) References Cited

U.S. PATENT DOCUMENTS

| | | | |
|---|---|---|---|
| 8,267,262 | B2 | 9/2012 | Thelwell |
| 9,227,757 | B1 | 1/2016 | Green et al. |
| 9,352,876 | B2 | 5/2016 | Muirhead |
| 2006/0236899 | A1 | 10/2006 | Nelson |
| 2014/0137774 | A1 | 5/2014 | Randall et al. |
| 2014/0251190 | A1 | 9/2014 | Kessler |
| 2016/0023803 | A1 | 1/2016 | Green et al. |

FOREIGN PATENT DOCUMENTS

| | | | |
|---|---|---|---|
| JP | 2005096804 | A | 4/2005 |
| KR | 20030069907 | A | 8/2003 |

OTHER PUBLICATIONS

Anderson et al., "Protecting Pallet Blocks," U.S. Appl. No. 15/293,854, filed Oct. 14, 2016.
List of IBM Patents or Patent Publications Treated as Related, Dated Jul. 25, 2017, 2 pages.

PROTECTING PALLET BLOCKS

BACKGROUND

The present invention relates to pallet protection, and more particularly to protecting blocks of a lightweight pallet.

SUMMARY

The present invention provides protection for blocks of lightweight pallets. The present invention provides a block protector assembly including a protector contoured to conform to a block of a pallet where the pallet includes a plurality of blocks, and an attachment mechanism coupled to the protector, where the attachment mechanism is configured to secure the protector to the block of the pallet, where the protector includes a rigid material. In an exemplary embodiment, the protector includes at least one protruding flange that is configured to extend past the block of the pallet such that the protruding flange is configured to cover a deck of the pallet. In an exemplary embodiment, the attachment mechanism includes one or more prongs. The present invention also provides a method including determining a contour of a block of a pallet, fabricating a protector to follow the contour of the block, and securing the protector to the block. In addition, the present invention provides a protector for preventing damage to a block of a pallet, where the protector includes a first side of the protector contoured to a first side of the block, a second side of the protector contoured to a second side of the block, and a third side of the protector contoured to a third side of the block.

DETAILED DESCRIPTION

The present invention provides protection for blocks of lightweight pallets. The present invention provides a block protector assembly including a protector contoured to conform to a block of a pallet where the pallet includes a plurality of blocks, and an attachment mechanism coupled to the protector, where the attachment mechanism is configured to secure the protector to the block of the pallet, where the protector includes a rigid material. In an exemplary embodiment, the protector includes at least one protruding flange that is configured to extend past the block of the pallet such that the protruding flange is configured to cover a deck of the pallet. In an exemplary embodiment, the attachment mechanism includes one or more prongs. The present invention also provides a method including determining a contour of a block of a pallet, fabricating a protector to follow the contour of the block, and securing the protector to the block. In addition, the present invention provides a protector including a protector for preventing damage to a block of a pallet, where the protector includes a first side of the protector contoured to a first side of the block, a second side of the protector contoured to a second side of the block, and a third side of the protector contoured to a third side of the block.

Lightweight pallets may be used as cost effective disposable replacements to more traditional wooden pallets. The use of corrugated paper pallets has been trending upward. However, damage to these pallets remains a reason why more companies have not made the change from standard wooden pallets. Corrugated pallets arrive to the customer with punctured blocks due to fork trucks shunting them throughout the products distribution. There is a need to mitigate the potential for damage, especially from a fork truck puncture. The term block generally refers to a support structure attached underneath the top deck of a pallet.

To overcome the fragility of lightweight pallets, the present invention provides support and protection to blocks of lightweight pallets.

Figure 1A:
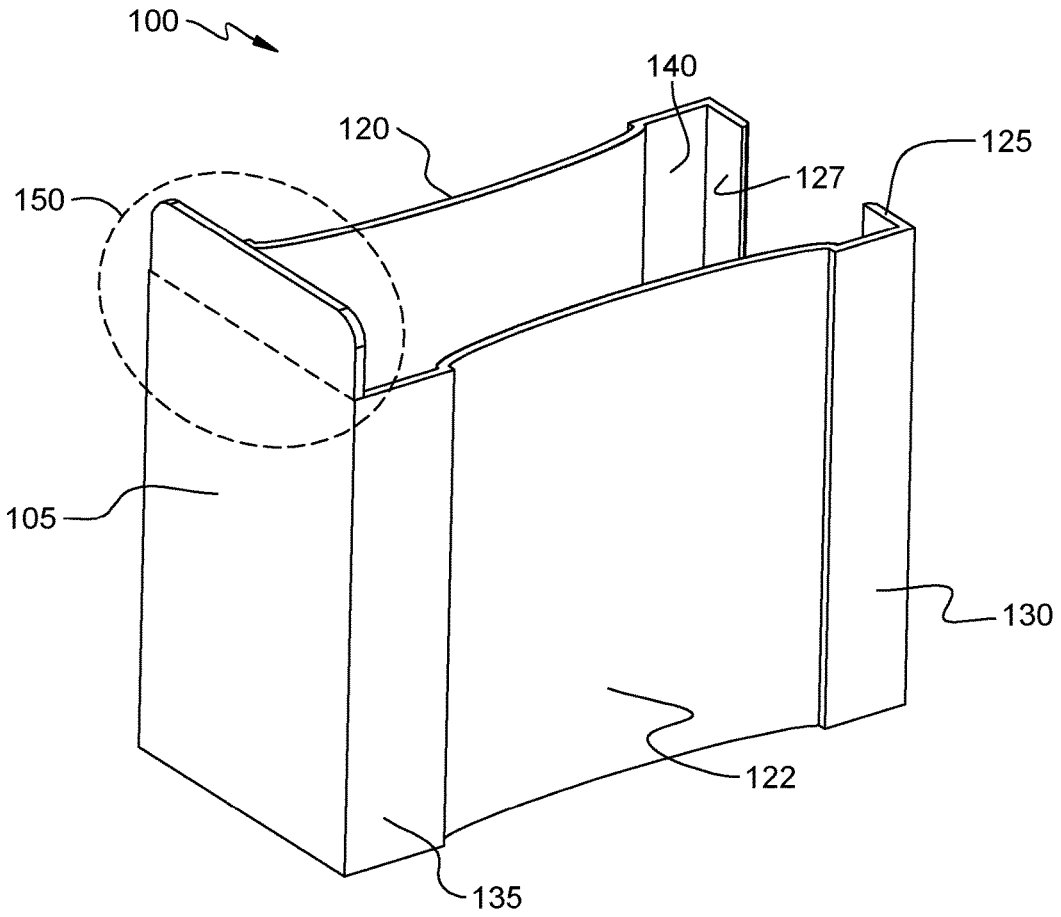
FIG. 1A is a perspective view of a protector according to an embodiment of the present invention.
Figure 1B:
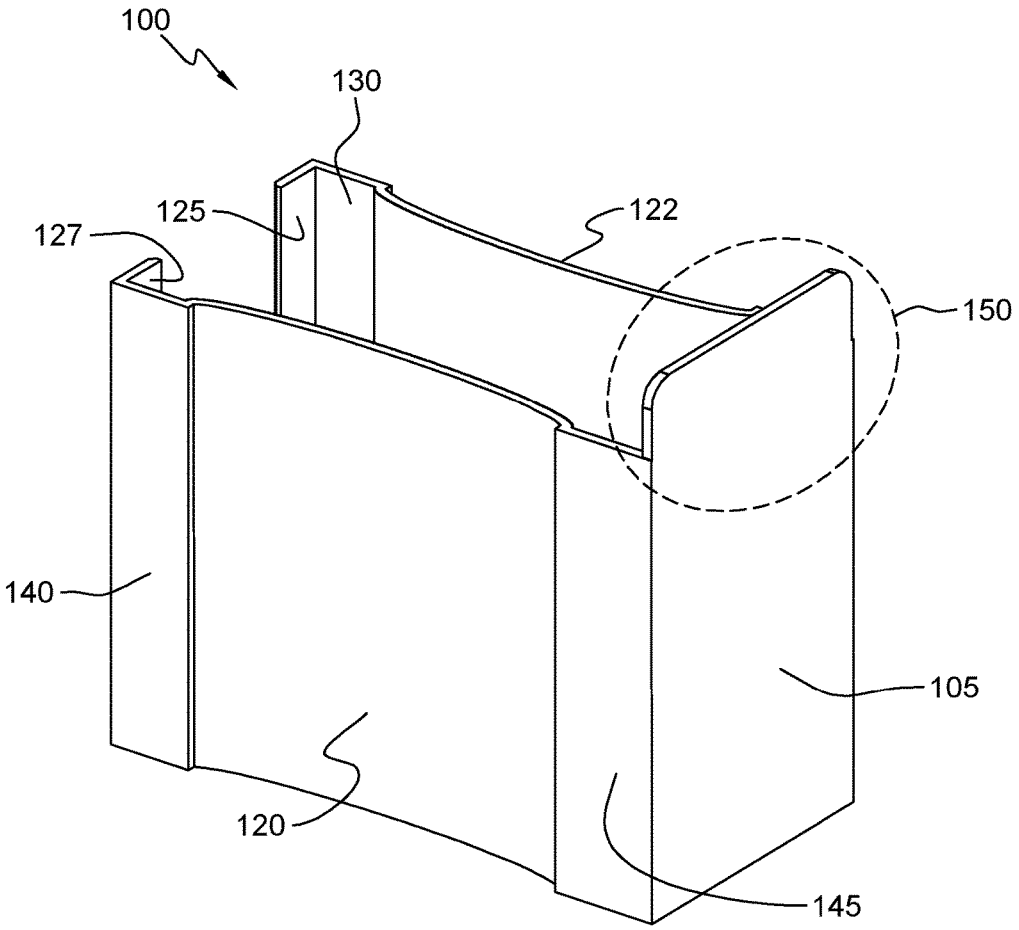
FIG. 1B is a perspective view of a protector according to an embodiment of the present invention.
Figure 1C:
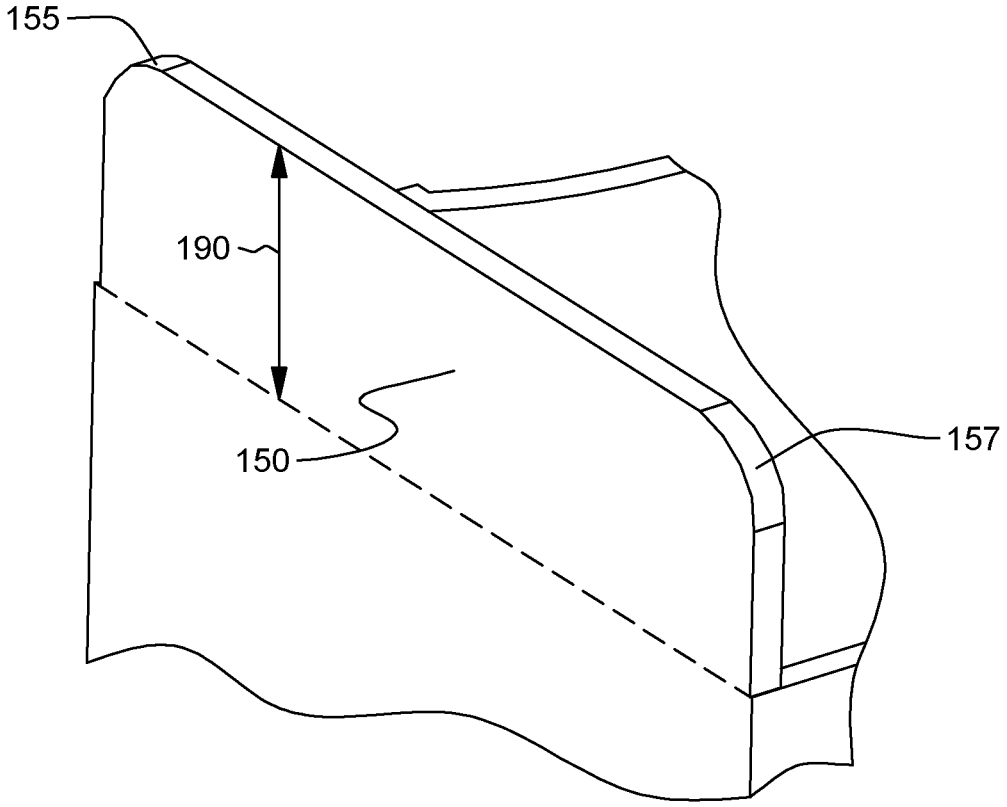
FIG. 1C is an exploded view of a flange according to an embodiment of the present invention.

Referring to FIG. 1A, FIG. 1B, and FIG. 1C, in an example embodiment, a block protector assembly includes a protector 100 contoured to conform to a block of pallet where the pallet includes a plurality of blocks, and an attachment mechanism coupled to protector 100, where the attachment mechanism is configured to secure protector 100 to the block of the pallet, where protector 100 includes a rigid material. In one embodiment protector 100 includes four sides, a first side 105, a second side which includes flat portions 135 and 130 and a curved portion 122, a third side which includes flat portions 145 and 140 and a curved portion 120, and a fourth side which includes prongs 125 and 127.

In a further embodiment, the attachment mechanism is configured to secure protector 100 to the block by a friction fit. Curves 120 and 122 create a lesser dimension than that of the width of a block. For example, when protector 100 is placed on the block of the pallet curved portions 120 and 122 press into the sides of the block, thus creating a holding effect/friction fit.

In a further embodiment, protector 100 includes at least one protruding flange 150 that is configured to extend past the block such that protruding flange 150 is configured to cover a deck of the pallet. Protruding flange 150 is designed to distribute an impact force to the deck as well as the block, which in turn reduces the likelihood of block separation and or puncture.

In a further embodiment, the attachment mechanism includes prongs 125 and 127. In an embodiment, prongs 125 and 127 are designed to fit onto a back side of the block. For example, prongs 125 and 127 are pulled outward while protector 100 gets pushed until it secures onto the block.

In one embodiment protector 100 includes, a fourth side, where the fourth side includes one or more prong(s) 125 and 127 configured to be secured to a fourth side of the block of the pallet, thereby being configured to secure protector 100 to the block of the pallet.

Figure 2:
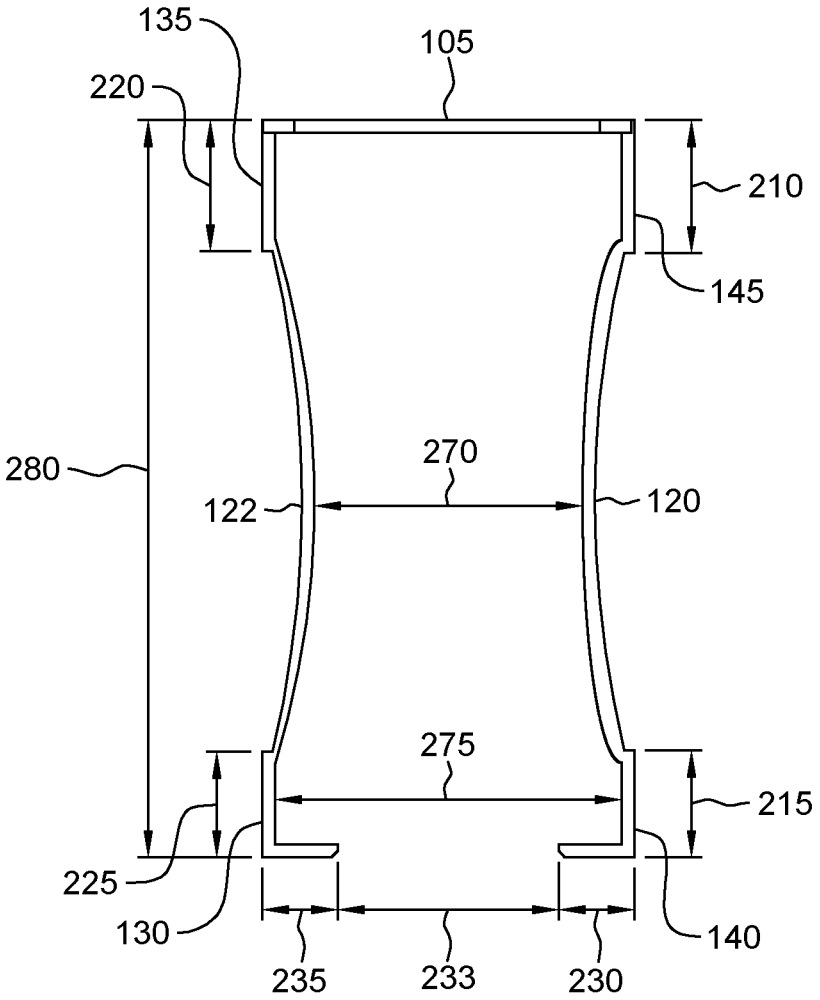
FIG. 2 is a top down view of a protector according to an embodiment of the present invention.

Referring to FIG. 2, in a further embodiment, the second side of protector 100 includes curved surface 122 such that at least one dimension 270 across protector 100 is smaller than a corresponding dimension across the block of the pallet. At rest protector 100 will have at least one dimension 270 that is smaller than at least one dimension of the block of the pallet. For example, when protector 100 is engaged onto the pallet, protector 100 will be pulled out or spread apart at the open side of protector 100 so that protector 100 will fit over the block. For example, when protector 100 is fully engaged, protector 100 will close around the block such that at least one point on protector 100, where dimension 270 is smaller than the block, will push into the block.

In one embodiment, one or more dimensions 235 and 230 of the one or more prongs 125 and 127 is at least 20 mm in length. Protector 100 is designed so that a gap 233 can be expanded to fit over the block of the pallet. For example, once protector 100 is fully engaged on the block, prongs 125 and 127 will latch onto the back of the block.

In one embodiment, the present invention provides a protector configured to prevent damage to a block of a pallet, where the protector includes first side 105 of the protector contoured to a first side of the block, the second side of the protector contoured to a second side of the block, and the third side of the protector contoured to a third side of the block. In this embodiment, the second side of protector 100 includes two flat regions 135 and 130 and one curved region 122. In this embodiment, the third side of protector 100 includes two flat regions 140 and 145 and one curved region 120.

In a further embodiment, the third side of protector 100 includes a curved surface 120 such that at least one dimension across protector 100 is smaller than a corresponding dimension across the block of the pallet. At rest protector 100 will have at least one dimension 270 that is smaller than at least one dimension of the block of the pallet. For example, when protector 100 is engaged onto the pallet, protector 100 will be pulled out or spread apart at the open side so it will fit over the pallet. For example, when protector 100 is fully engaged, protector 100 will close around the block. The regions where the dimension 270 is smaller than the block will push into protector 100.

In a further embodiment, protector 100 includes an inner surface where the inner surface is rough. The inner surface can be defined as some or all of the area of protector 100 that comes into contact with the pallet. In one embodiment, the inner surface/rough surface may include, but is not limited to, an abrasive coating or texture, ridges along the inner surface, and/or indentations on protector 100 to create an uneven surface.

Figure 3A:
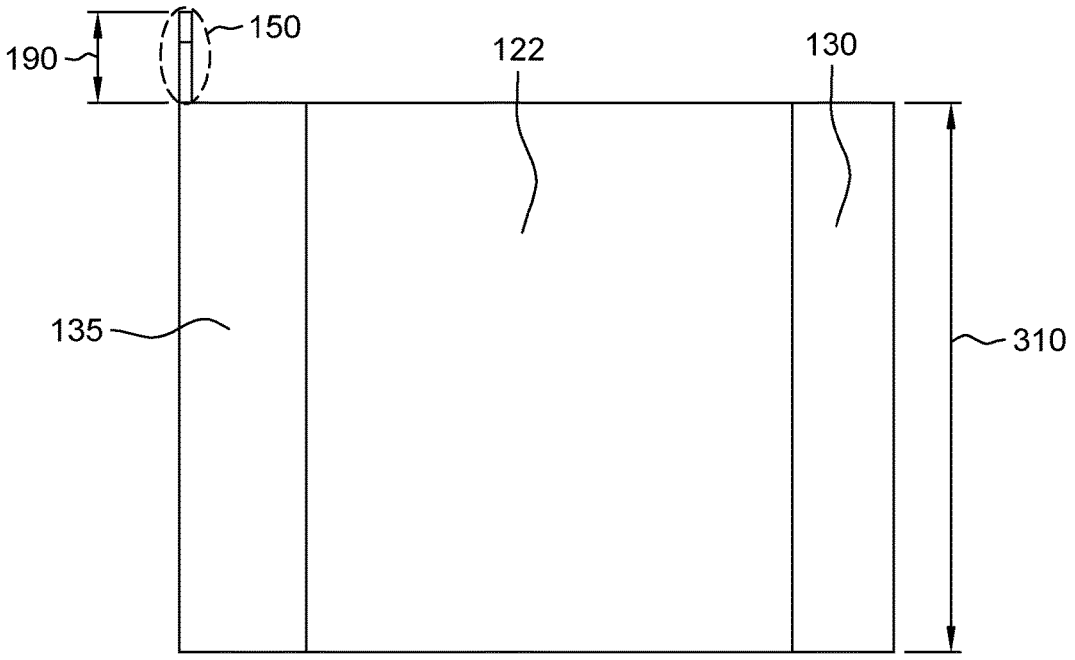
FIG. 3A is a side view of a protector according to an embodiment of the present invention.
Figure 3B:
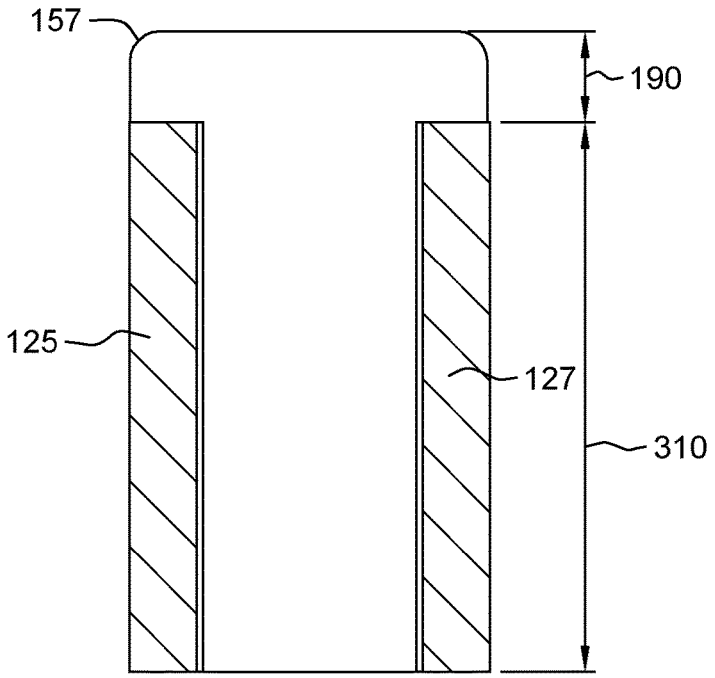
FIG. 3B is a back view of a protector according to an embodiment of the present invention.

Referring to FIG. 3A and FIG. 3B in one embodiment, protector 100 includes at least one protruding flange 150 that is configured to extend past the block of the pallet such that protruding flange 150 is configured to cover a deck of the pallet. In one embodiment, protruding flange 150 is designed to have a height 190 approximately equal to the height of the deck of the pallet. In one embodiment, flange 150 is designed to have a height 190 less than or equal to the height of the deck of the pallet. In one embodiment, a height 310 of protector 100 is approximately equal to the height of the block. In one embodiment, height 310 is less than or equal to the height of the block.

Figure 4A:
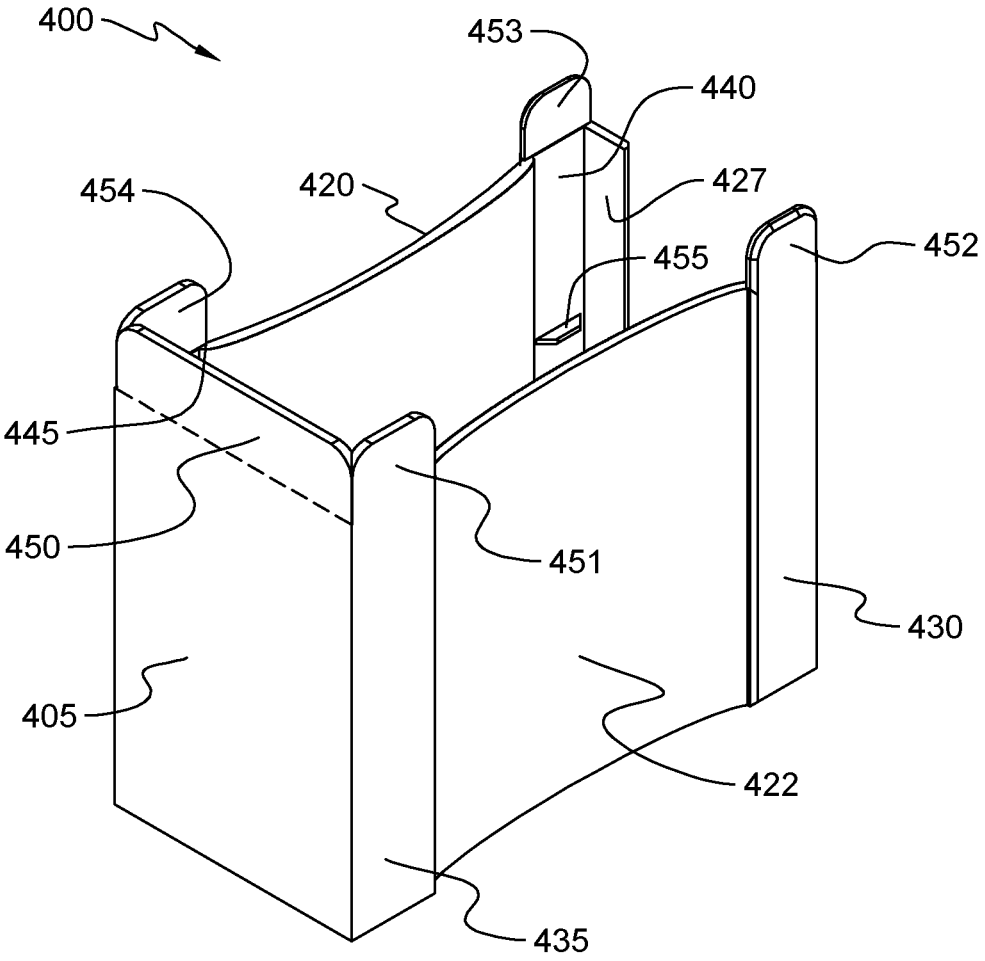
FIG. 4A is a perspective view of a protector according to an embodiment of the present invention.
Figure 4B:
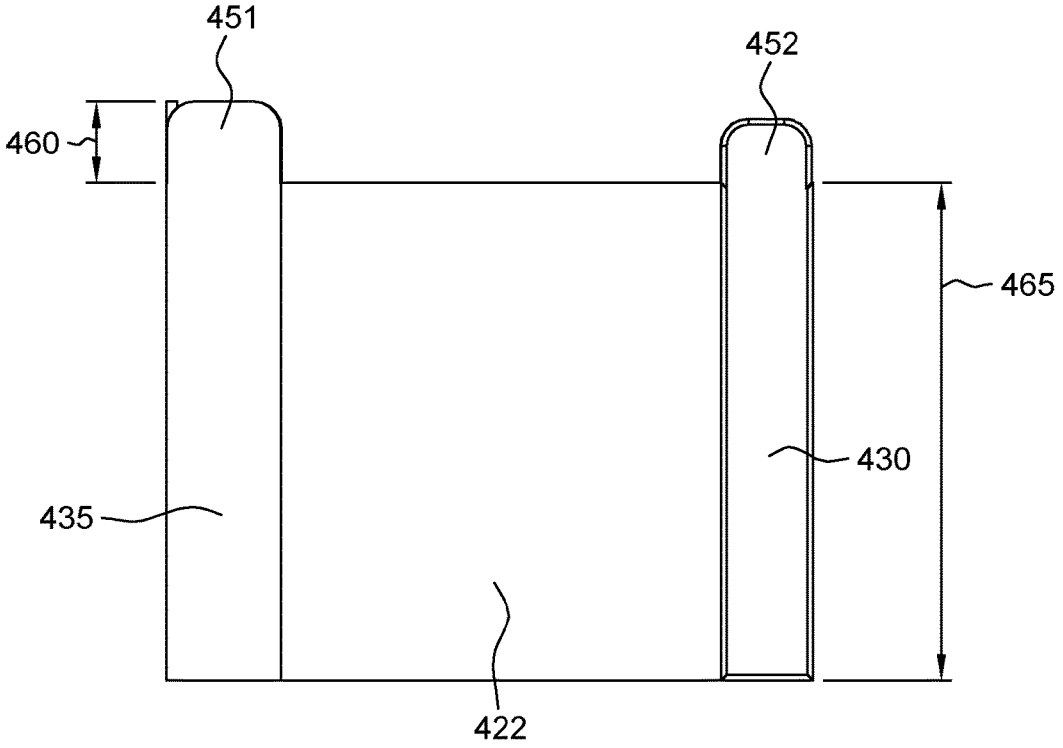
FIG. 4B is a perspective view of a protector according to an embodiment of the present invention.
Figure 4C:
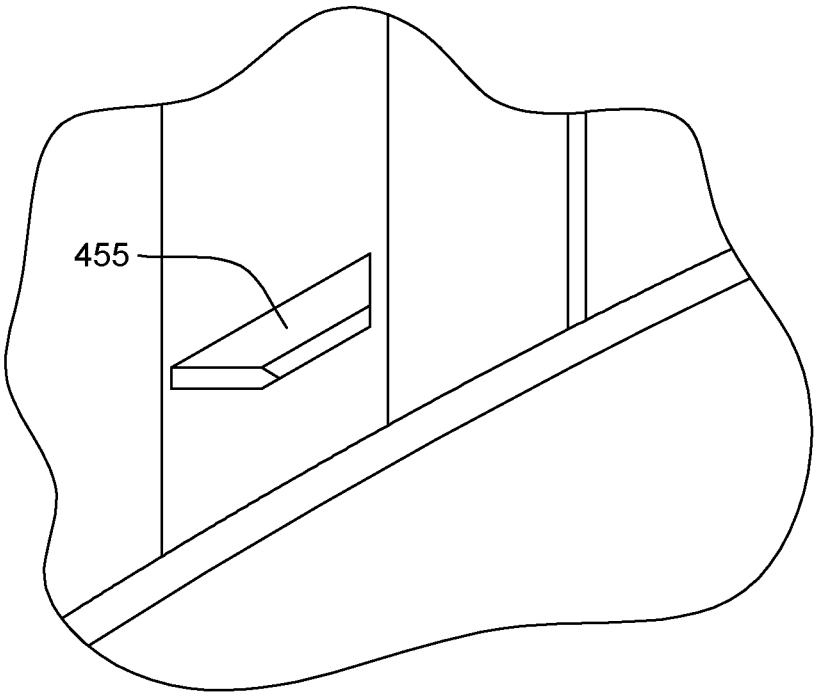
FIG. 4C is an exploded view of an indentation tab according to an embodiment of the present invention.

Referring to FIG. 4A, FIG. 4B, and FIG. 4C, in one embodiment, the attachment mechanism includes one or more indentation tabs 455 configured to secure protector 400 to the block of the pallet. Indentation tab(s) 455 is/are designed to be pressed into the body of the block in order to secure protector 400 to the block. For example, when indention tab(s) 455 is/are pressed into the block they will deform (e.g., push into) the body of the block at corresponding contact point(s).

In a further embodiment, protector 400 includes one or more indentation tabs 455 configured to secure protector 400 to the block of the pallet. Indention tabs 455 may be one or more pieces that are at an angle to the body of protector 400 pointing inward as seen in FIG. 4A. In an alternative embodiment, indention tab(s) 455 are on an edge of the protector.

In one embodiment protector 400 has side flanges 451, 452, 453, and 454. Side flanges 451, 452, 453, and 454 may be separate as shown in FIG. 4A or may be one continuous part for each side of protector 400. Side flanges 451, 452, 453, and 454 are designed to distribute an impact force onto the deck of the pallet, thereby protecting the pallet from impacts on the side of the pallet. In an alternative embodiment, protector 400 has flanges on two sides. For example, it may have flanges 450, 451, and 452. In an alternative embodiment, protector 400 has flanges on three sides. For example, it may have flanges 450, 451, 452, 453, and 454. In one embodiment protector 400 includes a front side or first side 405 with a front flange 450, a second side consisting of one or more flat portions 430 and 435 and a curved region 422 with one or more flanges 451 and 452, a third side consisting of one or more flat portions 440 and a curved region 420 with one or more flanges 453 and 454, and a fourth or back side consisting of one or more prongs 427. The main body of protector 400 is designed to have a height 465 less than or equal to the block. In one embodiment, side flanges 451, 452, 453, and 454 have a height 460 that is less than or equal to a height of the deck.

In one embodiment, the rigid material is selected from the group consisting of a metal, a plastic, a rubber, and a composite. For example, protector 100/400 could be made from a wide variety of sheet metals or plastics and could have coatings or other components made from other materials depending on the qualities desired.

Figure 5:
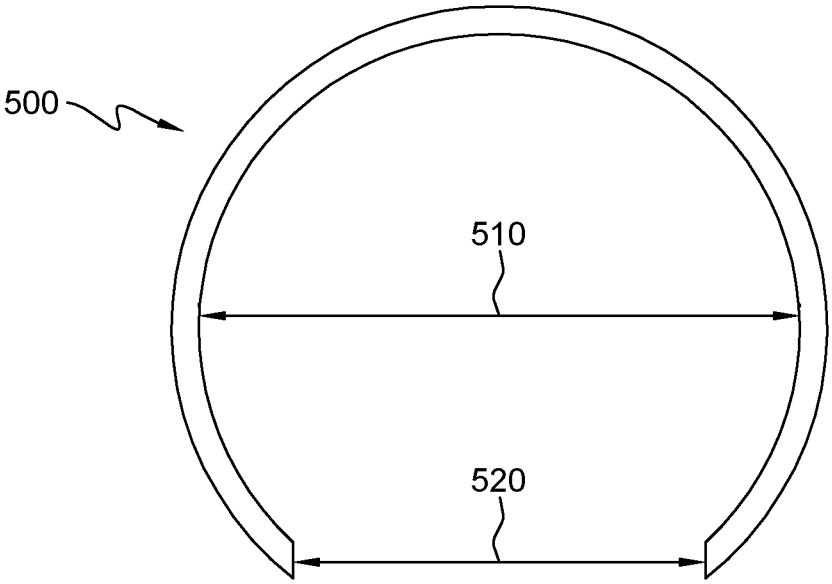
FIG. 5 is a top down view of a protector according to an embodiment of the present invention.

Referring to FIG. 5, in one embodiment, at least one side of protector 500 is curved. For example, this speaks to pallet blocks that are curved. Protector 500 is formed to follow the contour of a pallet block. In a further embodiment protector 500 can be formed such that an inner diameter 510 is smaller than an outer diameter of the pallet block. The shape of the pallet block and the shape of protector 500 are not limited to a rectangular or circular shape. Protector 500 can follow any shape that a pallet leg may take. For example, protector 500 could follow the shape of a pallet block that has one or more portions that are curved at one or more angles and may have one or more flat regions.

Figure 6:
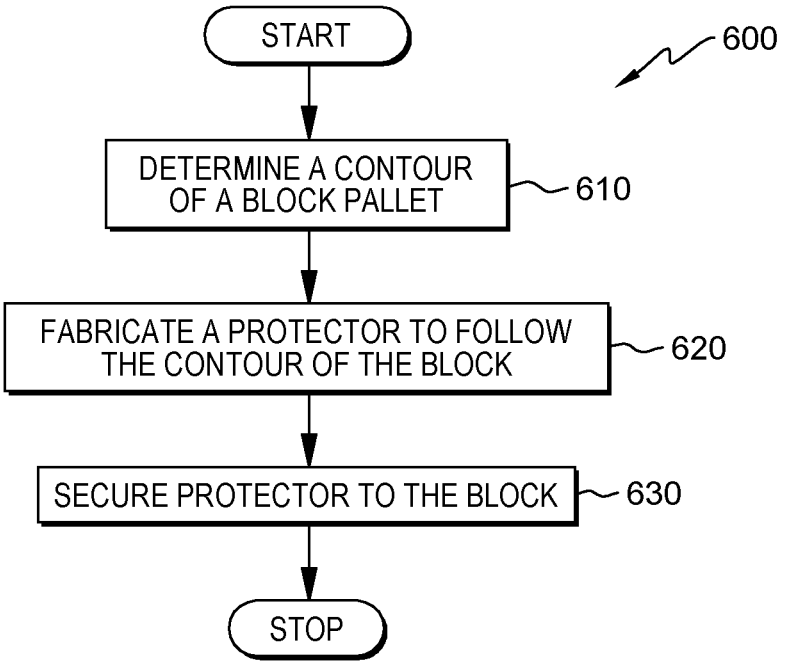
FIG. 6 is a flowchart according to an embodiment of the present invention.

Referring to FIG. 6, in one embodiment the present invention provides a method 600 including a step 610 of determining a contour of a block of a pallet, a step 620 of fabricating a protector, such as protector 100, to follow the contour of the block, and a step 630 of securing the protector to the block. For example, the shape of protector 100 is determined by the shape of the block to which it will fit, and prongs 125 and 127 are designed to fit around a back side of the block and to secure protector 100 onto the pallet.

In a further embodiment, securing step 630 includes securing one or more prongs 125 and 127 to the block of the pallet, thereby securing protector 100 to the block. Prongs 125 and 127 are formed to fit on the back side of the block to mitigate sliding or movement of protector 100 on the block. In a further embodiment, fabricating step 620 includes extending protruding flange 150 such that protector

100 is configured to extend past the block of the pallet such that protruding flange 150 is configured to cover a deck of the pallet.

In a further embodiment, securing step 630 includes securing protector 100 to a block by a friction fit. Protector 100 is formed such that it can press against a block when protector 100 is secured to the pallet. This is accomplished by forming protector 100 such that curved regions 120 and 122 can press into the block. For example, flat regions 135, 145, 130, and 140 are designed such that they can come into contact with the surface of the block when protector 100 is engaged to the pallet, since distance 275 is the width of the block. Regions 120 and 122 are designed such that dimension 270 would be less than the width of a block. For example, when the block protector 100 is engaged to the block, curved regions 120 and 122 press against the block creating a friction fit.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A block protector assembly comprising:

a protector contoured to conform to a block of a pallet wherein the pallet comprises a plurality of blocks, wherein the protector comprises a rigid material, wherein the protector includes at least one protruding flange that is configured to extend past the block of the pallet such that the protruding flange is configured to cover a deck of the pallet, wherein the protruding flange is designed to distribute an impact force to both the deck of the pallet and the block of the pallet, wherein the protector includes four sides, a first side, a second side including two flat portions and a curved portion, a third side including two flat portions and a curved portion, and a fourth side, wherein at least one dimension between the curved portion of the second side and the curved portion of the third side is smaller than a corresponding dimension across the block of the pallet; and an attachment mechanism coupled to the protector, wherein the attachment mechanism is configured to secure the protector to the block of the pallet by a friction fit, wherein the attachment mechanism includes one or more prongs, wherein the one or more prongs are designed to fit on a back side of the block of the pallet.

* * * * *